US008736413B2

(12) United States Patent
Yokoyama et al.

(10) Patent No.: US 8,736,413 B2
(45) Date of Patent: May 27, 2014

(54) LAMINATED TYPE INDUCTOR ELEMENT AND MANUFACTURING METHOD THEREFOR

(71) Applicant: Murata Manufacturing Co., Ltd., Nagaokakyo (JP)

(72) Inventors: Tomoya Yokoyama, Nagaokakyo (JP); Tetsuya Ikeda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/709,091

(22) Filed: Dec. 10, 2012

(65) Prior Publication Data

US 2013/0154785 A1 Jun. 20, 2013

(30) Foreign Application Priority Data

Dec. 14, 2011 (JP) ..... 2011-273097

(51) Int. Cl.
*H01F 5/00* (2006.01)
*H01F 27/28* (2006.01)
*H01F 27/24* (2006.01)

(52) U.S. Cl.
USPC ..... 336/200; 336/223; 336/232; 336/233

(58) Field of Classification Search
USPC ..... 336/200, 223, 232
See application file for complete search history.

(56) References Cited

U.S. PATENT DOCUMENTS 6,459,351 B1 * 10/2002 Maki et al. ..... 336/200
6,515,568 B1 * 2/2003 Maki et al. ..... 336/200
7,211,533 B2 * 5/2007 Kawada et ..... 501/128
7,446,638 B2 * 11/2008 Nogi ..... 336/200
7,557,307 B2 * 7/2009 Nishizawa et al. ..... 174/384
7,719,398 B2 * 5/2010 Tsuzuki ..... 336/200
2002/0008606 A1 * 1/2002 Okuyama et al. ..... 336/200
2002/0024781 A1 * 2/2002 Ooshima et al. ..... 360/324.12
2007/0069844 A1 * 3/2007 Kudo et al. ..... 336/83

(Continued)

FOREIGN PATENT DOCUMENTS

JP 04-065807 A 3/1992
JP 06-204039 A 7/1994

(Continued)

OTHER PUBLICATIONS

English translation of JP2003209017.*

(Continued)

*Primary Examiner* — Elvin G Enad
*Assistant Examiner* — Ronald Hinson
(74) *Attorney, Agent, or Firm* — Keating & Bennett, LLP

(57) ABSTRACT

In a laminated inductor element, a magnetic ferrite layer sandwiched between two conductor patterns is thinner than other magnetic ferrite layers. Therefore, a crack occurs in the magnetic ferrite layer due to firing. As a result of the occurrence of this crack, a stress applied to each layer is relaxed, and it becomes possible to avoid warpage, a crack, or the like. In addition, in the laminated type inductor element, the two conductor patterns are electrically connected by two via holes, and subjected to a same potential. Since the two conductor patterns correspond to a same wiring pattern and a coil of coil conductor is defined by the two conductor patterns, even if upper and lower coil conductors are electrically in contact with each other due to the crack, the two conductor patterns are not put into a short-circuited state.

15 Claims, 3 Drawing Sheets

(56) References Cited

U.S. PATENT DOCUMENTS

| | | | | |
|---|---|---|---|---|
| 2008/0135155 | A1* | 6/2008 | Kawamura et al. | 156/89.11 |
| 2010/0085140 | A1* | 4/2010 | Tanaka et al. | 336/221 |
| 2011/0036622 | A1* | 2/2011 | Chikagawa et al. | 174/257 |

FOREIGN PATENT DOCUMENTS

| | | | |
|---|---|---|---|
| JP | 2003-209017 | A | 7/2003 |
| JP | 2004-039957 | A | 2/2004 |
| JP | 2005-072267 | A | 3/2005 |
| JP | 2005-268391 | A | 9/2005 |
| JP | 2009-044030 | A | 2/2009 |

OTHER PUBLICATIONS

English translation of JP2003209017 06/25/03.*

* cited by examiner

THROUGH HOLE IS FORMED

FILLED WITH CONDUCTIVE PASTE

CONDUCTOR PATTERN IS FORMED

LAMINATION

FIRING

LAMINATED TYPE INDUCTOR ELEMENT AND MANUFACTURING METHOD THEREFOR

BACKGROUND OF THE INVENTION

1. Field of the Invention

The present invention relates to a laminated type inductor element including conductor patterns and ceramic green sheets laminated on each other and a manufacturing method for the laminated type inductor element.

2. Description of the Related Art

In the past, inductor elements have been known to be formed by printing and laminating conductor patterns on a ceramic green sheet including a magnetic substance material. When a laminated type inductor component is used for a choke coil for a DC-DC converter, a large inductance value is desirable. In the past, so as to improve a direct-current superimposition characteristic or so as to achieve stress relaxation due to a difference in the thermal shrinkage ratios of magnetic substance materials, it has been proposed to provide an air gap within a laminated body. Such a technique is disclosed in Japanese Unexamined Patent Application Publication No. 4-65807, for example.

So as to provide an air gap, it is desirable to apply a carbon paste, which is to disappear at the time of firing. Thus, an extra process is necessary.

SUMMARY OF THE INVENTION

Therefore, preferred embodiments of the present invention provide a laminated type inductor element including a configuration that provides the same function as an air gap without an increase in the number of processes, and a manufacturing method for the laminated type inductor element.

According to a preferred embodiment of the present invention, a laminated type inductor element includes a laminated body including a plurality of layers including a magnetic substance, and an inductor including coil conductors provided between layers of the laminated body and connected in a lamination direction of the laminated body, wherein, in the lamination direction of the laminated body, at least one portion has an interval between the coil conductors that is narrower than another interval, and coil conductors located over and under the at least one portion are electrically connected so as to be subjected to a same potential.

When such a laminated type inductor element is fired, a stress occurs due to a difference in coefficients of thermal expansion between the ceramic green sheets and the coil conductor. In addition, since at least one portion is provided where an interval between coil conductors is narrower than another interval, a large number of cracks occur in the at least one portion. As a result of the cracks, the stress is relaxed, and the same function as an air gap is obtained. Furthermore, since the coil conductors located over and under the at least one portion are subjected to a same potential, if upper and lower coil conductors are electrically in contact with each other, the coil conductors are not put into a short-circuited state.

In addition, it is desirable that the coil conductors are formed using conductive pastes including silver and include fine powder where an average particle diameter of silver particles is substantially less than or equal to about 1 μm, for example. When the metal particles are atomized, and an average particle diameter becomes substantially less than or equal to about 1 μm, for example, a melting point is decreased. Accordingly, since, in the ceramic green sheet and the coil conductor, a difference in thermal shrinkage occurs when a temperature rises at the time of firing, it may be possible to reliably cause a crack to occur.

In addition, it may be possible to adopt a preferred embodiment where glass is added to the coil conductors. Since, by adding a low-melting-point material, in the ceramic green sheet and the coil conductor, a difference in thermal shrinkage also occurs when a temperature rises at the time of firing, it may be possible to reliably cause a crack to occur.

According to various preferred embodiments of the present invention, it is possible to realize a configuration having the same function as an air gap without an increase in the number of processes.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
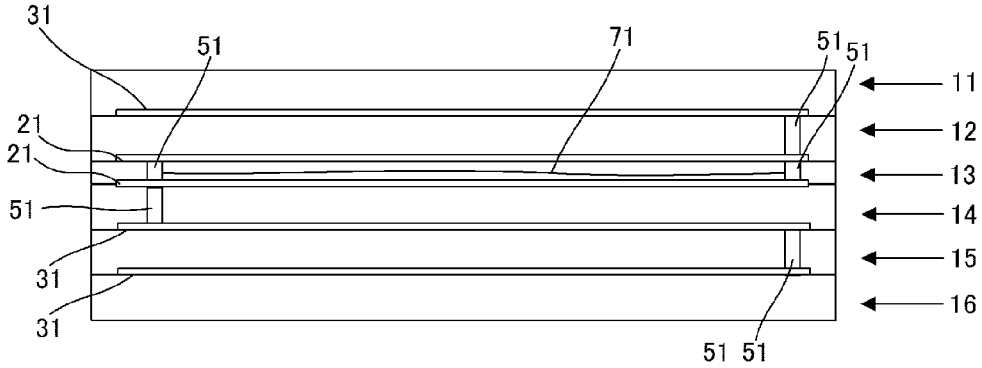
FIG. 1 is a cross-sectional view schematically illustrating a laminated type inductor element according to a preferred embodiment of the present invention.

FIG. 1 is a cross-sectional view schematically illustrating a laminated type inductor element according to a preferred embodiment of the present invention. In the cross-sectional view illustrated in FIG. 1, it is assumed that the upper side of the plane of paper corresponds to the top surface side of the laminated type inductor element and the lower side of the plane of paper corresponds to the bottom surface side of the laminated type inductor element. In addition, while, in the present preferred embodiment, the laminated type inductor element will be described as a laminated type inductor element where all ceramic green sheets to be laminated preferably are magnetic substances, actually, ceramic green sheets serving as magnetic substances and non-magnetic substances are preferably laminated in the laminated type inductor element.

The laminated type inductor element includes a laminated body including a plurality (e.g., preferably six in this example) of magnetic ferrite layers including magnetic ferrite layers 11 through 16 are disposed in this order from a top surface side toward a bottom surface from among outermost layers.

On some ceramic green sheets configuring the laminated type inductor element, internal wiring lines are provided. In the drawing, on the top surfaces of the magnetic ferrite layer 12, the magnetic ferrite layer 15, and the magnetic ferrite layer 16, conductor patterns 31 are preferably made of conductive pastes. In addition, on the top surfaces of the magnetic ferrite layer 13 and the magnetic ferrite layer 14, conductor patterns 21 are also preferably made of conductive pastes.

The conductor pattern 21 and the conductor pattern 31 are electrically connected in a lamination direction through the via holes 51. With respect to each ceramic green sheet, a punch hole is made at a predetermined position, and the punch hole is filled with a conductive paste, thereby forming the via hole 51.

In this way, wiring lines are implemented in a substantially spiral manner across a magnetic ferrite layer, and hence, a coil conductor is formed. Accordingly, the laminated body functions as an inductor. In this regard, however, the two conductor patterns 21 located on the top surfaces of the magnetic ferrite layer 13 and the magnetic ferrite layer 14 preferably correspond to or have a same wiring pattern, and these two conductor patterns 21 define a coil or one turn coil conductor.

In addition, while, in the example in FIG. 1, an example is illustrated where the conductor patterns 31 are formed on the top surfaces of the magnetic ferrite layer 12, the magnetic ferrite layer 15, and the magnetic ferrite layer 16, the conductor patterns 31 may be formed on the bottom surfaces of the magnetic ferrite layer 11, the magnetic ferrite layer 14, and the magnetic ferrite layer 15. In addition, the conductor patterns 21 may not be formed on the top surfaces of the magnetic ferrite layer 13 and the magnetic ferrite layer 14 but may be formed on the bottom surfaces of the magnetic ferrite layer 12 and the magnetic ferrite layer 13.

In addition, when magnetic ferrite layers and non-magnetic ferrite layers are laminated, it is desirable that the magnetic ferrite layer having a relatively high thermal shrinkage ratio is sandwiched between the non-magnetic ferrite layers having relatively low thermal shrinkage ratios and hence, an entire element is compressed due to firing, thereby improving the intensity thereof. For example, ferrite including iron, nickel, zinc, and copper is preferably used as the magnetic ferrite layer, and ferrite including iron, zinc, and copper is preferably used as the non-magnetic ferrite layer.

In addition, the main component of the conductor pattern 21 and the conductor pattern 31 is a material (for example, silver) whose coefficient of thermal expansion is higher than that of the ceramic green sheets of the magnetic ferrite layer and the non-magnetic ferrite layer. Since the ceramic green sheet serving as a material whose coefficient of thermal expansion is low is sandwiched between the conductor patterns serving as materials whose coefficients of thermal expansion are high, a tensile stress occurs in the ceramic green sheet at the time of firing.

In addition, in the laminated type inductor element in the present preferred embodiment, at least one portion is provided where an interval between coil conductors is narrower than another interval. In other words, the magnetic ferrite layer 13 sandwiched between the conductor patterns 21 is thinner than other magnetic ferrite layers. Therefore, in the magnetic ferrite layer 13, a crack 71 occurs due to firing. As a result of the occurrence of the crack 71, a stress applied to each layer is relaxed, and it is possible to avoid warpage, a crack, or the like, in the entire element.

As described above, the crack 71 occurs as a result of a tensile stress due to a differential shrinkage occurring when a temperature falls at the time of firing. Accordingly, the crack 71 mainly occurs in a surface direction. In this regard, however, the crack 71 occasionally occurs in a lamination direction along a pore within ferrite or the via hole 51.

Therefore, in the laminated type inductor element of the present preferred embodiment, the two conductor patterns 21 are electrically connected by the two via holes 51, and subjected to a same potential. In addition, since the two conductor patterns 21 correspond to the same wiring pattern and a coil of coil conductor is defined by the two conductor patterns 21, even if upper and lower coil conductors are electrically in contact with each other, the two conductor patterns 21 are not put into a short-circuited state because of the crack 71.

In addition, the magnetic ferrite layer 13 may be thinned by reducing the number of ceramic green sheets compared with other magnetic ferrite layers, and may be thinned using a thin ceramic green sheet.

In addition, it is desirable that the conductor pattern 21 and the conductor pattern 31 are formed using conductive pastes including silver and fine powder where the average particle diameter of silver particles is substantially less than or equal to about 1 μm, for example. While the sintering start temperature of the magnetic ferrite layer or the non-magnetic ferrite layer preferably is about 700° C. to about 800° C., for example, the sintering start temperature of a conductive paste including silver of a particle diameter of the related art (for example, substantially greater than or equal to 1 μm) is about 600° C. to 700° C. Therefore, a differential shrinkage is small when a temperature rises at the time of firing. On the other hand, in the case of a conductive paste including metal nanoparticles where an average particle diameter is substantially less than or equal to about 1 μm, a melting point is further decreased. Accordingly, since a large differential shrinkage occurs when a temperature rises at the time of firing, it may be possible to reliably cause the crack 71 to occur. In this regard, however, since a cost increases with a decrease in the particle diameter while the melting point is greatly decreased with a decrease in the particle diameter, in view of the cost, it is desirable that the composition of the conductive paste is determined so that a difference in sintering start temperature is about 200° C. to about 400° C., for example.

In addition, it may be possible to adopt a preferred embodiment where low-melting-point glass is added to the conductive paste. Since the melting point is also decreased as the conductive paste when the low-melting-point glass is added, a difference in thermal shrinkage occurs when a temperature rises at the time of firing. Accordingly, in this case, it may also be possible to cause a crack to occur when a temperature rises at the time of firing. In this regard, however, since a resistance value increases with an increase in an addition amount, it is desirable that the addition amount is set to about 5 wt % at a maximum, for example.

Figure 2:
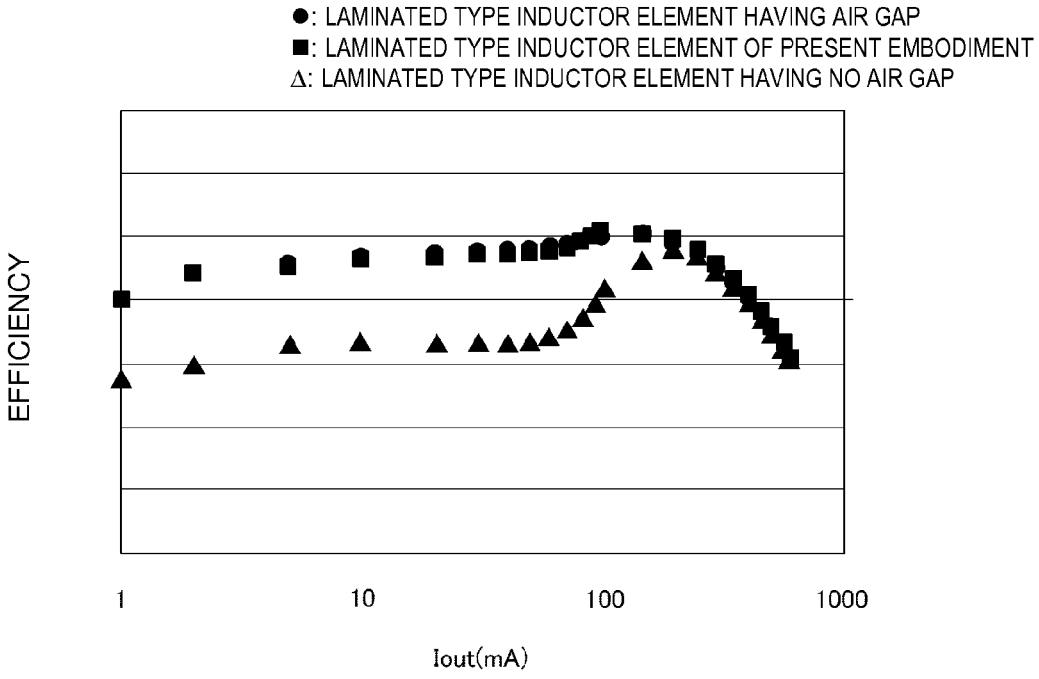
FIG. 2 is a characteristic comparison diagram of laminated type inductor elements.

The crack 71, which is caused to occur as described above, first occurs as a result of a stress that is generated due to a difference in thermal shrinkage between layers at the time of firing. Accordingly, the crack 71 relaxes a stress applied to other layers, and has the same function as an air gap of the related art. FIG. 2 is the characteristic comparison diagram of laminated type inductor elements. As illustrated in FIG. 2, while a laminated type inductor element having an air gap illustrates a high efficiency compared with a laminated type inductor element having no air gap, the laminated type inductor element causing the crack 71 to occur, illustrated in the present preferred embodiment, also illustrates the similar efficiency as that of the laminated type inductor element having an air gap.

In this way, in the laminated type inductor element of the present preferred embodiment, it may not be necessary to preliminarily apply a material such as a carbon paste that is to disappear at the time of firing and become an air gap, and it may be possible to realize a configuration having a similar function as an air gap.

Next, a non-limiting example of a manufacturing process for the laminated type inductor element will be described. The laminated type inductor element is manufactured in accordance with the following process. FIGS. 3A to 3E are diagrams illustrating a manufacturing process for the laminated type inductor element. While, in FIGS. 3A to 3E, for purpose of explanation, only a portion is illustrated where the magnetic ferrite layer 12, the magnetic ferrite layer 13, and the magnetic ferrite layer 14 are laminated, actually a large number of ceramic green sheets are preferably laminated. In addition, while a large number of coils are simultaneously formed in one laminated body, FIGS. 3A to 3E illustrate, for the purpose of explanation, an example where one coil is formed in one laminated body.

Figure 3A:
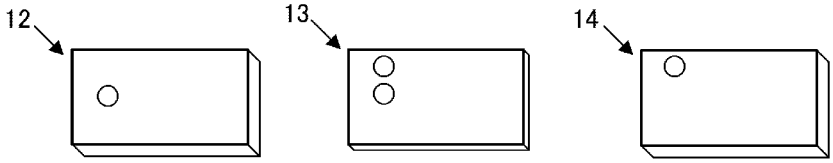
FIGS. 3A to 3E are diagrams illustrating a manufacturing process for a laminated type inductor element according to a preferred embodiment of the present invention.

First, a ceramic green sheet to be a magnetic ferrite layer or a non-magnetic ferrite layer is prepared. In addition, as illustrated in FIG. 3A, a punch hole is made at a point to be the via hole 51 with respect to each ceramic green sheet. The shape of the punch hole is not limited to a circular or substantially circular shape, and may be another shape such as a rectangular or substantially rectangular shape or a semicircular or substantially semicircular shape.

Figure 3B:
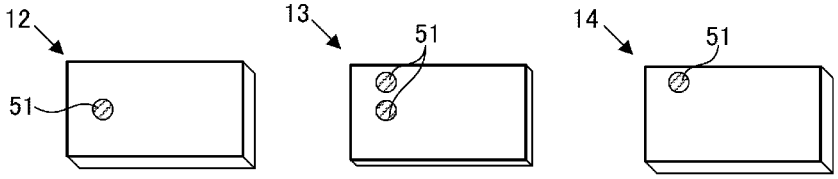
Figure 3C:
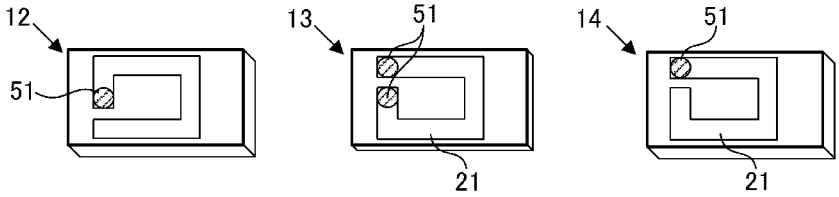
Figure 3D:
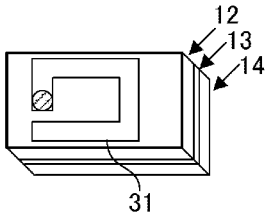
Figure 3E:
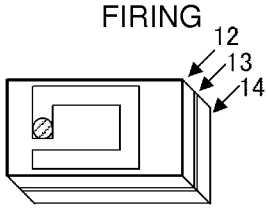

In addition, as illustrated in FIG. 3B, the punch hole in each ceramic green sheet is filled with a conductive paste, thereby forming the via hole 51. After that, as illustrated in FIG. 3C, a conductive paste is applied, and internal wiring lines in the conductor pattern 21, the conductor pattern 31, and the like are formed. In addition, the via hole 51 may be formed after the conductor pattern 21 and the conductor pattern 31 have been formed.

In this regard, however, as described above, the two conductor patterns 21 correspond to the same wiring pattern, and owing to the two conductor patterns 21, a coil of coil conductor is formed. A large number of via holes 51 connecting the two conductor patterns 21 may further be provided.

Next, each ceramic green sheet is laminated. In the example in FIG. 3C, the magnetic ferrite layer 12, the magnetic ferrite layer 13, and the magnetic ferrite layer 14 are individually laminated in this order from a top surface side, and temporal pressure bonding is performed. Accordingly, a mother laminated body before firing is formed.

In addition, firing is performed. Accordingly, the fired mother laminated body is obtained. At the time of this firing, the crack 71 occurs in the magnetic ferrite layer 13.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A laminated inductor element comprising:

a laminated body including a plurality of layers including a magnetic substance and laminated on each other in a lamination direction; and an inductor including coil conductors provided between the plurality of layers of the laminated body and connected in the lamination direction; wherein in the lamination direction, an interval between a pair of directly opposing ones of the coil conductors which are arranged on opposite sides of one of the plurality of layers including the magnetic substance is narrower than an interval between another pair of directly opposing ones of the coil conductors which are arranged on opposite sides of another one of the plurality of layers including the magnetic substance, and coil conductors located over and under the at least one portion are electrically connected so as to be subjected to a same potential.

2. The laminated inductor element according to claim 1, wherein the coil conductors include conductive pastes including silver and fine powder in which an average particle diameter of silver particles is less than or equal to about 1 μm.

3. The laminated inductor element according to claim 1, wherein glass is added to the coil conductors.

4. The laminated inductor element according to claim 2, wherein glass is added to the coil conductors.

5. The laminated inductor element according to claim 1, wherein the plurality of layers of the laminated body are magnetic ferrite layers.

6. The laminated inductor element according to claim 5, wherein the coil conductors include wiring lines arranged in a substantially spiral manner across respective ones of the magnetic ferrite layers.

7. The laminated inductor element according to claim 1, wherein the coil conductors include wiring lines arranged in a substantially spiral manner across respective ones of the plurality of layers of the laminated body.

8. The laminated inductor element according to claim 1, wherein the coil conductors include conductor patterns located on top surfaces of respective ones of the plurality of layers of the laminated body.

9. The laminated inductor element according to claim 1, wherein the coil conductors include conductor patterns located on bottom surfaces of respective ones of the plurality of layers of the laminated body.

10. The laminated inductor element according to claim 1, wherein the plurality of layers of the laminated body include magnetic ferrite layers and non-magnetic ferrite layers.

11. The laminated inductor element according to claim 10, wherein the magnetic ferrite layers having a relatively high thermal shrinkage ratio are sandwiched between the non-magnetic ferrite layers having relatively low thermal shrinkage ratios.

12. The laminated inductor element according to claim 8, wherein a coefficient of thermal expansion of the coil conductors is higher than that of the plurality of layers of the laminated body.

13. The laminated inductor element according to claim 9, wherein a coefficient of thermal expansion of the coil conductors is higher than that of the plurality of layers of the laminated body.

14. The laminated inductor element according to claim 1, further comprising a crack in a surface direction in one of the plurality of layers of the laminated body.

15. The laminated inductor element according to claim 1, further comprising a crack in the lamination direction in one of the plurality of layers of the laminated body.

* * * * *